US006125477A

United States Patent [19]

Crippa et al.

[11] Patent Number: 6,125,477

[45] Date of Patent: Oct. 3, 2000

[54] CRASH-HELMET WITH DEVICE FOR LOCKING AND RELEASING MOVABLE PARTS

[75] Inventors: Bruno Crippa, Merate; Claudio Rivolta, Robbiate; Luigi Mazza, Trezzo s/Adda, all of Italy

[73] Assignee: AGV S.p.A., Spinetta Marengo, Italy

[21] Appl. No.: 09/336,584

[22] Filed: Jun. 21, 1999

[30] Foreign Application Priority Data

Jun. 25, 1998 [IT] Italy ..... MI98A1458

[51] Int. Cl.[7] ..... A42B 3/04

[52] U.S. Cl. ..... 2/422; 2/424; 2/10; 2/12

[58] Field of Search ..... 2/410, 411, 422, 2/424, 425, 15, 10, 12, 6.3, 6.5, 6.7

[56] References Cited

U.S. PATENT DOCUMENTS 3,066,305 12/1962 Aileo ..... 2/6
3,400,407 9/1968 Aileo ..... 2/6
3,748,657 7/1973 Aileo ..... 2/6
4,615,052 10/1986 Nava ..... 2/424
5,461,731 10/1995 Shida ..... 2/424

*Primary Examiner*—Michael A. Neas
*Attorney, Agent, or Firm*—Guido Modiano; Albert Josif; Daniel O'Byrne

[57] ABSTRACT

A crash-helmet with a device for locking and releasing movable parts comprising a helmet body and a part which is associated with the helmet body and is movable with respect to the helmet body along a movement path. The device for locking and releasing the movable part comprises a first member, which is associated with the movable part and is provided with engagement regions which are mutually spaced along the movement path, and a second member, which is associated with the helmet body and is provided with at least one retention element which engages at least one of the engagement regions. The retention element is flexible in order to allow the movement of the movable part with respect to the helmet body, sequentially engaging the engagement regions when the movable part moves with respect to the helmet body. The device also comprises a locking member which can engage the retention element in order to prevent its elastic yielding, locking the movement of the movable part with respect to the helmet body, or can be disengaged from the retention element to allow its elastic yielding.

9 Claims, 5 Drawing Sheets

CRASH-HELMET WITH DEVICE FOR LOCKING AND RELEASING MOVABLE PARTS

BACKGROUND OF THE INVENTION

The present invention relates to a crash-helmet with a device for locking and releasing movable parts, such as for example visors, attached chin-guards, front guards or sunshades, sliders or panels for opening and closing air intakes, etcetera.

Crash-helmets are generally provided with one or more movable parts which are associated with the body of the helmet so that they are movable with respect to it. This is the case, for example, of the visor, which is usually hinged, at its lateral ends, to two opposite lateral regions of the helmet body about a hinge axis which is parallel to the front of the helmet.

Other types of helmet are provided with a front guard or sunshade which is hinged to two lateral-upper regions of the helmet body and protrudes at the front above the front opening of the helmet.

In other types of helmet of the open-face type, there can be an attached chin-guard which is also hinged to the helmet body at two lateral-lower regions about a hinge axis which is substantially parallel to the front of the helmet.

As regards visors, several types of device for allowing to retain the visor in an intermediate position with respect to the extreme open and closed positions are known.

However, these retention devices are structurally complicated and do not always ensure with sufficient safety the locking of the visor in an intermediate position.

As regards front guards or sunshades and attached chin-guards, they are generally associated with the helmet body by means of a screw which provides hinging and by means of an additional screw passing through a curved slot the center of curvature whereof lies on the hinge axis and which is formed in the body of the front guard or attached chin-guard. The front guard or chin-guard is locked in the intended position by tightening the screw that passes through the slot.

These devices for locking and releasing the movable parts, particularly as regards front guards or sunshades and attached chin-guards, are awkward to use because they necessarily require to loosen the screw that provides the locking action and to subsequently tighten it after the front guard or chin-guard have been moved to the intended position.

SUMMARY OF THE INVENTION

The aim of the present invention is to solve the above-described problems, providing a crash-helmet with a device for locking and releasing movable parts which is extremely simple and easy to use.

Within the scope of this aim, an object of the invention is to provide a crash-helmet with a device for locking and releasing movable parts which can be adopted for front guards or sunshades, for attached chin-guards, visors, and panels or sliders for opening and closing air intakes etcetera.

Another object of the invention is to provide a crash-helmet with a device for locking and releasing movable elements which is constituted by an extremely limited number of elements which can be manufactured at low costs and are simple and quick to assemble.

Another object of the invention is to provide a crash-helmet with a device for locking and releasing movable parts which offers adequate assurances of stability of the locking action once it has been performed.

This aim, these objects and others which will become apparent hereinafter are achieved by a crash-helmet with a device for locking and releasing movable parts, comprising a helmet body and a part which is associated with said helmet body and is movable with respect to said helmet body along a movement path, a device being provided for locking and releasing said movable part, characterized in that said device comprises a first member, which is associated with said movable part and is provided with engagement regions mutually spaced along said movement path, and a second member, which is associated with the helmet body and is provided with at least one retention element engaging at least one of said engagement regions, said retention element being flexible in order to allow the movement of said movable part with respect to the helmet body and sequentially engaging said engagement regions when said movable part moves with respect to the helmet body, a locking member being provided which can engage said retention element in order to prevent its elastic yielding, locking the movement of said movable part with respect to the helmet body, or can be disengaged from said retention element to allow its elastic yielding.

BRIEF DESCRIPTION OF THE DRAWINGS

Further characteristics and advantages of the present invention will become apparent from the following detailed description of a preferred but not exclusive embodiment of the helmet according to the invention, illustrated by way of nonlimitative example in the accompanying drawings, wherein.

DESCRIPTION OF THE PREFERRED EMBODIMENTS

Figure 2:
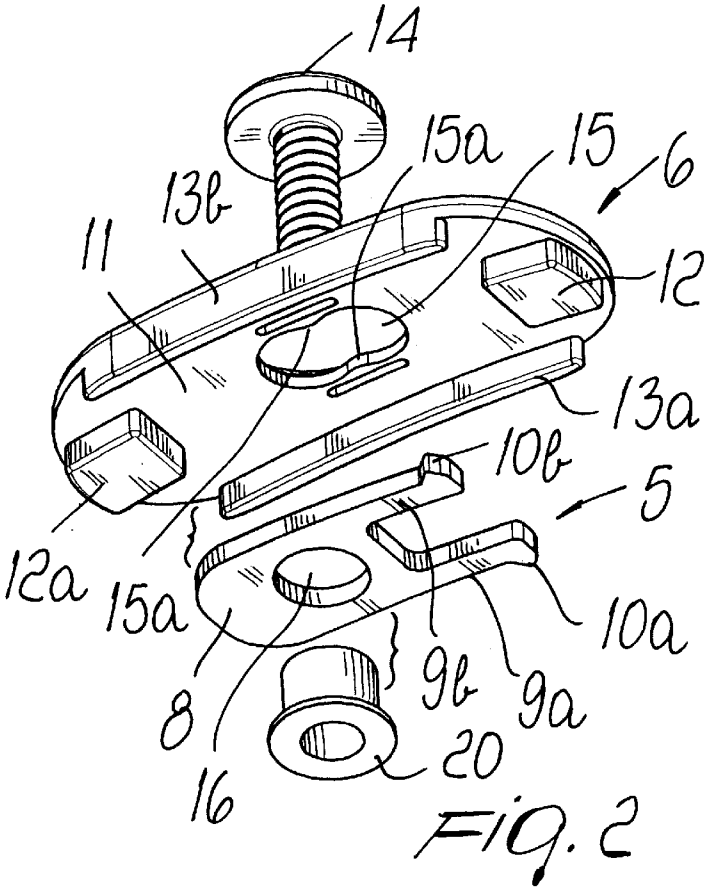
FIG. 2 is an exploded perspective view of parts of the device, taken at a different angle with respect to FIG. 1.
Figure 1:
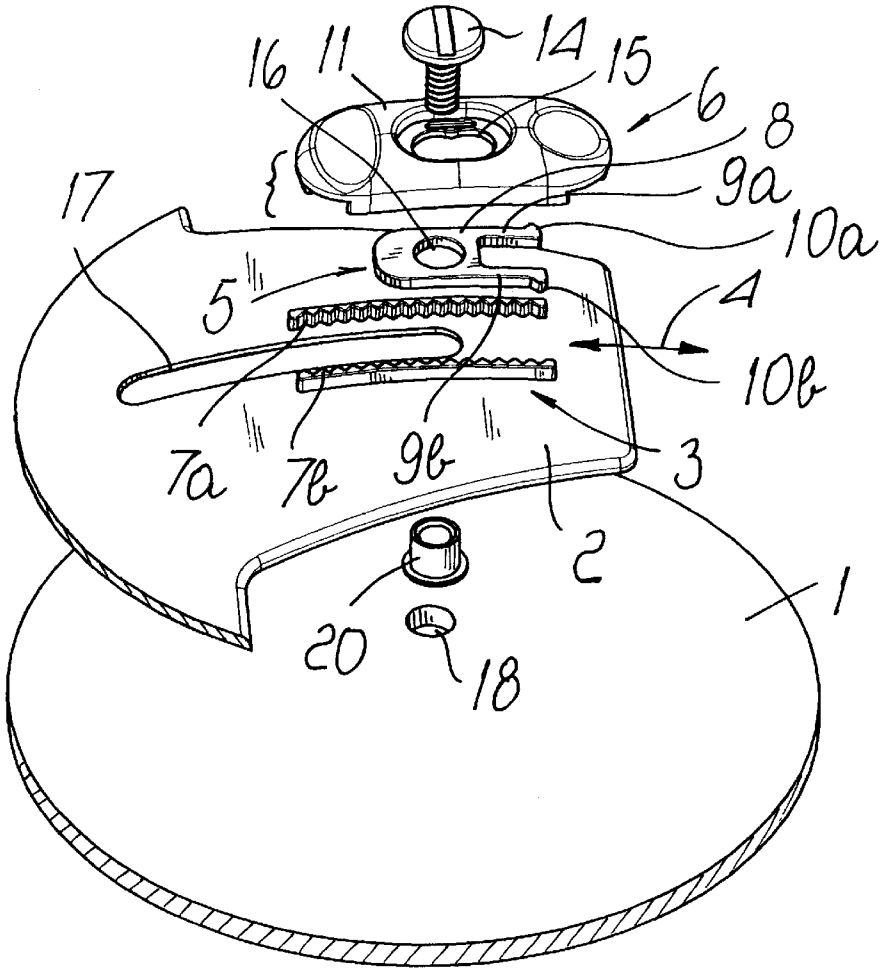
FIG. 1 is an exploded perspective view of the device for locking and releasing movable parts of the helmet according to the invention.
Figure 3:
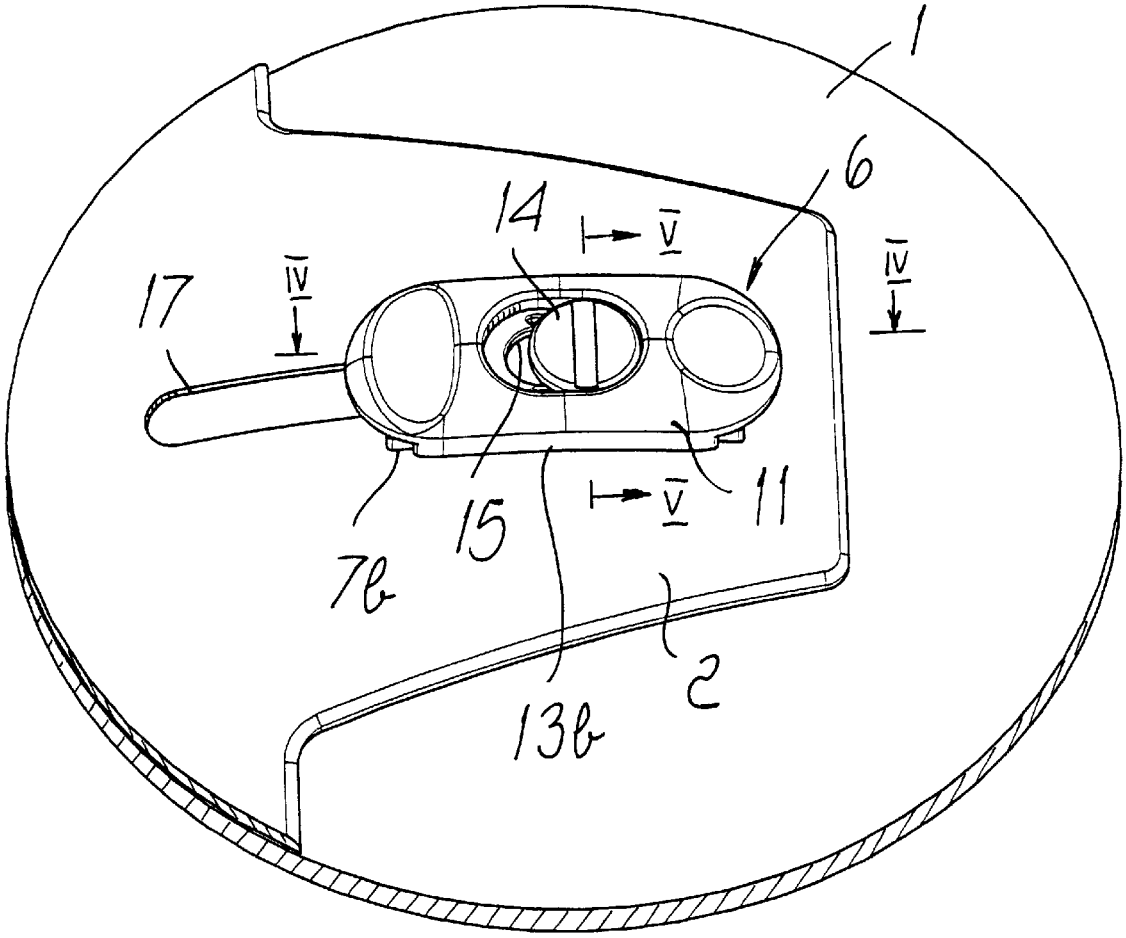
FIG. 3 is a perspective view of the locking and releasing device attached to the top of a helmet according to the invention in order to lock a front guard.
Figure 4:
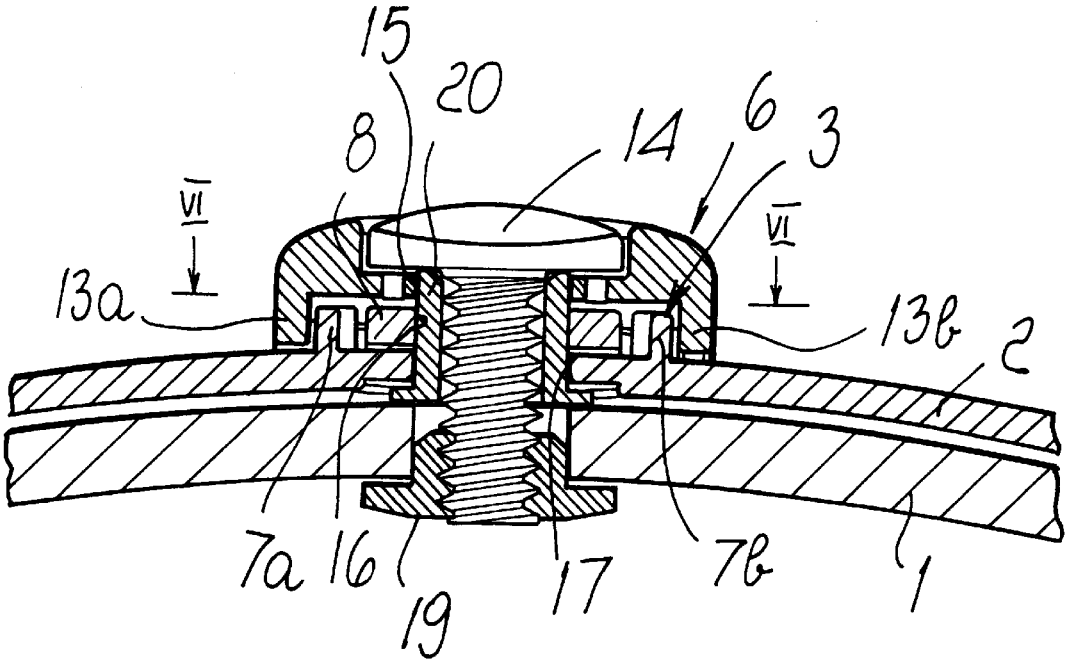
FIG. 4 is an enlarged-scale sectional view of FIG. 3, taken along the plane IV—IV.
Figure 5:
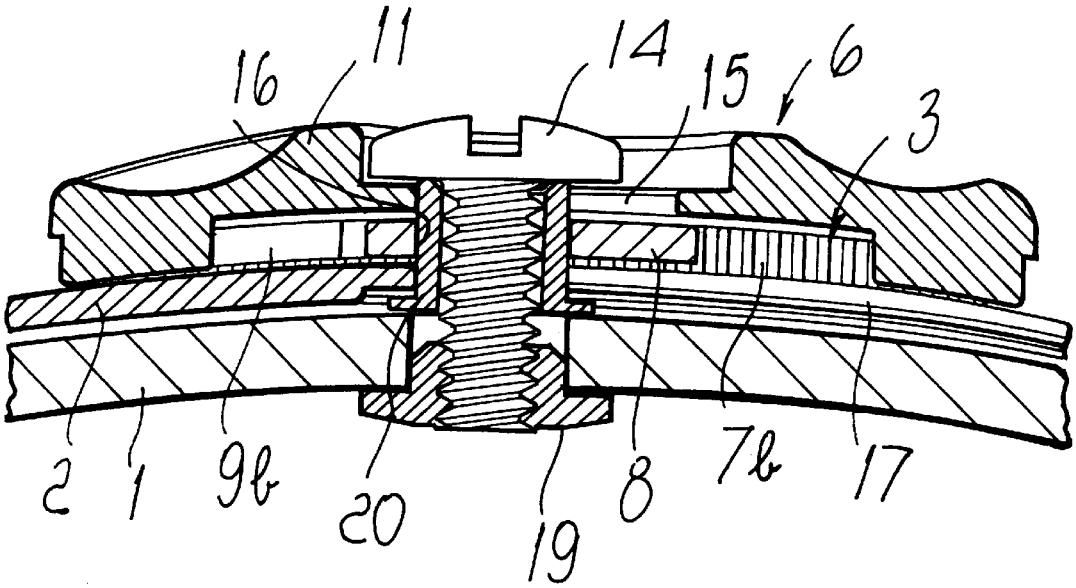
FIG. 5 is an enlarged-scale sectional view of FIG. 3, taken along the plane V—V.
Figure 7:
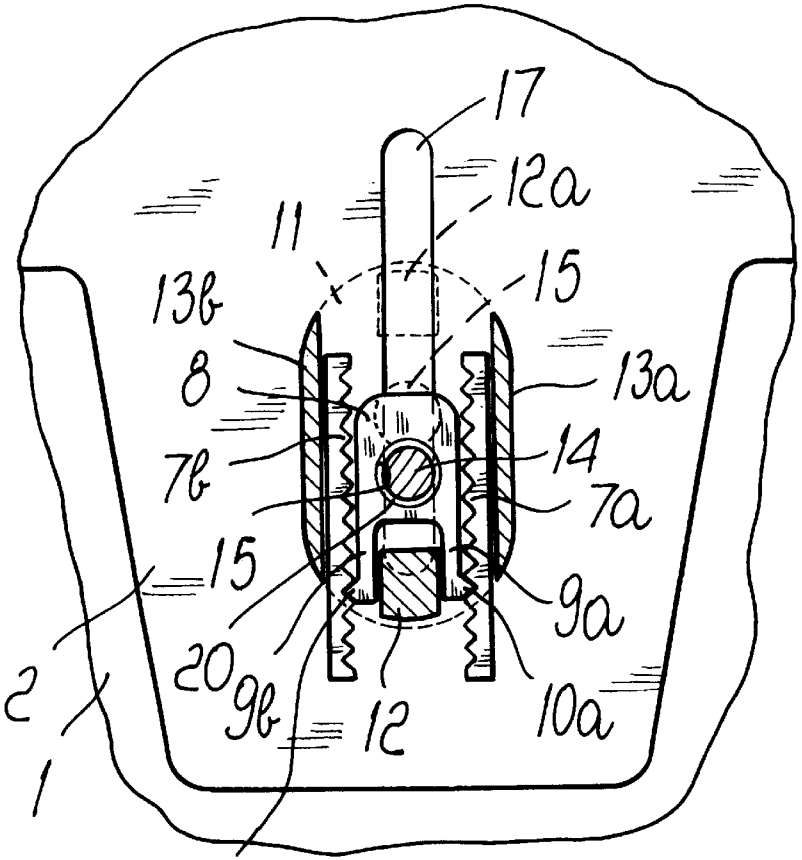
FIG. 7 is a sectional view, taken like FIG. 6, with the locking member in the position for engaging the retention element.

With reference to the above figures, the helmet according to the invention comprises a helmet body 1 and a part 2 which is associated with the helmet body 1 and is movable with respect to it along a movement path which can be straight or curved, as will become apparent hereinafter.

The helmet according to the invention comprises a device for locking and releasing the movable part 2.

In FIGS. 1 to 7, the device is shown in its application for locking and releasing a front guard or sunshade. In this case, the movable part 2 is constituted by a portion of the front guard which is hinged, in a per se known manner, to two lateral-upper regions of the helmet body 1 about an axis which is parallel to the front of the helmet. The movable part 2 constitutes the upper portion of the front guard, which lies above the top of the helmet body 1.

The device for locking and releasing the movable part 2 comprises a first member 3 which is associated with the movable part 2 and is provided with engagement regions which are mutually spaced along the movement path of the movable part 2 with respect to the helmet body 1, which is shown by the arrow 4.

The device for locking and releasing the movable part 2 comprises a second member 5 which is associated with the body of the helmet 1 and is provided with at least one retention element which engages at least one of the engagement regions of the first member 3.

The retention element of the second member 5 yields elastically in order to allow the movement of the movable part 2 with respect to the helmet body 1, sequentially engaging the engagement regions of the first member 3 when the movable part 2 moves with respect to the helmet body 1.

The device further comprises a locking member 6, which can engage in the retention element of the second member 5 to prevent its elastic yielding, locking the movement of the movable part 2 with respect to the helmet body 1, or can be disengaged from the retention element in order to allow it to yield elastically.

More particularly, the first member 3 comprises at least one rack which is rigidly coupled to the movable part 2.

Conveniently, two mutually facing racks 7*a* and 7*b*, which lie parallel to the path 4, are provided. The racks 7*a* and 7*b* have, on their mutually facing sides, a plurality of teeth alternated with grooves which form the engagement regions for the second member 5, which are mutually spaced parallel to the path 4.

The second member 5 comprises a block 8 which is associated with the helmet body 1, and the retention element for the second member 5 is constituted by at least one flexible wing provided with a lug which can engage or disengage, by way of its flexibility, the grooves of the set of teeth of the rack or racks 7*a* and 7*b*.

Conveniently, the block 8 is arranged between the racks 7*a* and 7*b* and is provided with a pair of wings 9*a* and 9*b* elastically flexible towards or away from each other. The wings 9*a* and 9*b* respectively have, at their free ends, a lug 10*a* and 10*b* which engages one of the racks 7*a* or 7*b*. The elastic flexibility of the lugs 9*a* and 9*b* towards each other allows the lugs 10*a* and 10*b* to disengage and engage sequentially the grooves of the racks 7*a* and 7*b*, allowing the sliding of the movable part 2 with respect to the helmet body 1 along the path 4.

The locking member 6 comprises a slider 11 which is associated with the helmet body 1 and is provided with a locking tooth 12. The slider 11 is movable on command from a locking position, in which it engages, by means of its locking tooth 12, the wings 9*a* and 9*b* to prevent their elastic flexing, to a release position, in which the locking toothed 12 is disengaged from the wings 9*a* and 9*b*.

More particularly, the locking tooth 12 is arranged between the wings 9*a* and 9*b* and the movement of the slider 11 occurs parallel to the path 4 from the release position, in which the tooth 12 is disengaged from the wings 9*a* and 9*b* to allow their elastic flexing towards each other, to the locking position, in which the locking tooth 12 is arranged between the wings 9*a* and 9*b* to prevent the elastic flexing of the wings towards each other.

The slider 11 is further provided, on the side directed toward the racks 7*a* and 7*b*, with a pair of side walls 13*a* and 13*b* which slidingly couple to the sides of the racks 7*a* and 7*b* lying opposite with respect to the toothed sides, in order to guide the slider 11 in its sliding to pass from the locking position to the release position and viceversa.

The slider 11 is associated with the helmet body 1 by means of a screw 14 which passes through a slot 15 formed in the slider 11, a hole 16 formed in the block 8, a slot 17 formed in the movable part 2, and a hole 18 formed in the helmet body 1. The screw 14 engages a nut 19 which is arranged on the inner side of the helmet body 1, i.e., on the opposite side of the helmet body 1 with respect to the side whereon the movable part 2 is arranged.

The slot 17 of the movable part 2 is elongated in a direction which is parallel to the path 4, so as to allow the movable part 2 to move with respect to the helmet body 1 despite the presence of the screw 14.

A bush 20 is further arranged around the shank of the screw 14 and passes through the slot 17 and the slot 15.

The slot 15 also is elongated in a direction which is parallel to the path 4 and is shaped so as to have a median narrower region 15*a* and two wider end regions, so that the median narrower region 15*a* produces friction against the bush 20 in order to keep the slider 11 in the locking position or in the release position.

For the sake of completeness in description, it should be noted that on the side of the slider 11 that is directed toward the racks 7*a* and 7*b* a second locking tooth 12*a* is provided which is arranged symmetrically with respect to the locking tooth 12 relative to the slot 15. The locking tooth 12*a* has no effect in preventing the elastic flexing of the wings 9*a* and 9*b* but is merely used to simplify the assembly of the slider 11, which can be associated with the helmet body 1 equally in one position or in another position which is rotated through 180 degrees about the axis of the screw 14.

Operation of the device for locking and releasing movable parts in the helmet according to the invention is as follows.

Figure 6:
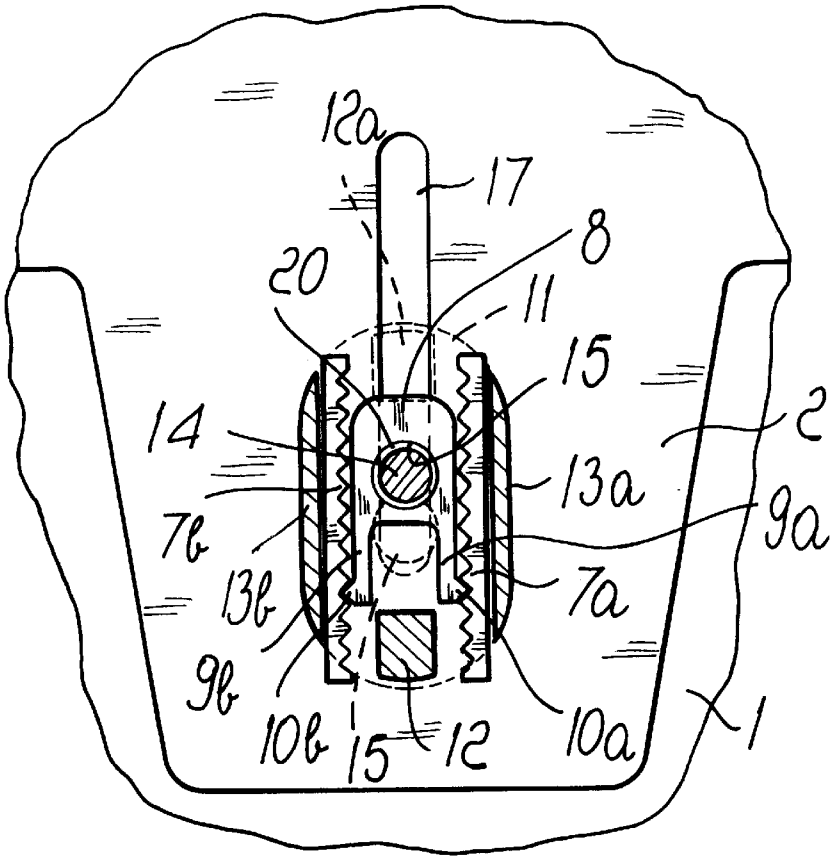
FIG. 6 is a sectional view of FIG. 4, taken a along the plane VI—VI, with the locking member disengaged from the retention element.

In order to move the movable part 2 with respect to the helmet body 1, it is sufficient to move the slider 11 into the release position, i.e., the position in which the locking tooth 12 is disengaged from the wings 9*a* and 9*b*, as shown in particular in FIG. 6. When the locking tooth 12 is in this position, by acting on the movable part 2 it is possible to move it along the path 4, since the wings 9*a* and 9*b* can flex towards each other. During the movement, the wings 9*a* and 9*b* flex towards each other and the teeth 10*a* and 10*b* engage sequentially the grooves provided between the teeth of the racks 7*a* and 7*b*, retaining the movable part 2 in the intended position. After the movable part 2 has been positioned, it can be locked with respect to the helmet body 1 by moving the slider 11 into the locking position, i.e., by moving the locking tooth 12 between the wings 9*a* and 9*b*, as shown in particular in FIG. 7. The engagement of the locking tooth 12 between the wings 9*a* and 9*b* prevents said wings from being able to flex elastically towards each other, disengaging from the teeth of the racks 7*a* and 7*b*.

Figure 8:
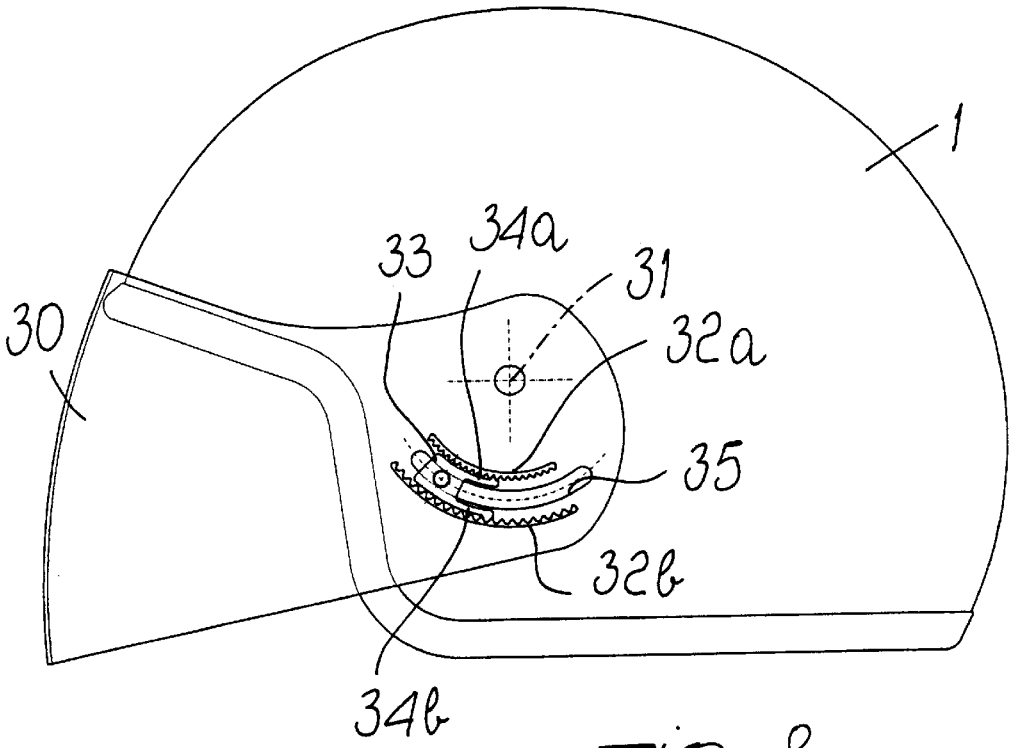
FIG. 8 is a schematic view of a helmet according to the invention with the device for locking and releasing movable parts applied to the visor.

The device for locking and releasing movable parts, described with particular reference to FIGS. 1 to 7 in its application to a sunshade or front guard, can in any case also be used to lock and release other movable parts provided on a helmet, such as for example a visor 30, as shown in FIG. 8, which is hinged, at it lateral ends, to two lateral opposite regions of the helmet body 1 about a hinge axis 31 which is parallel to the front of the helmet. In this case, the path of the visor 30 is a curved path around the axis 31. Instead of the racks 7*a* and 7*b* two racks 32*a* and 32*b* are provided which are rigidly coupled to the visor 30 and have an arc-like shape centered on the hinge axis 31.

The second member is constituted by a block 33, which is similar to the block 8 and is provided with two elastically flexible wings 34*a* and 34*b* which are similar to the wings 9*a* and 9*b* but are curved so that they can engage the racks 32*a* and 32*b* by means of their end lugs, which are similar to the lugs 10*a* and 10*b*. The slot 35 corresponding to the slot 17 also has an arc-like shape which is centered on the hinge axis 31 and the slider, which corresponds to the slider 11, not shown for the sake of simplicity, is movable from the locking position to the release position along a curved path which is centered on the axis 31.

Figure 9:
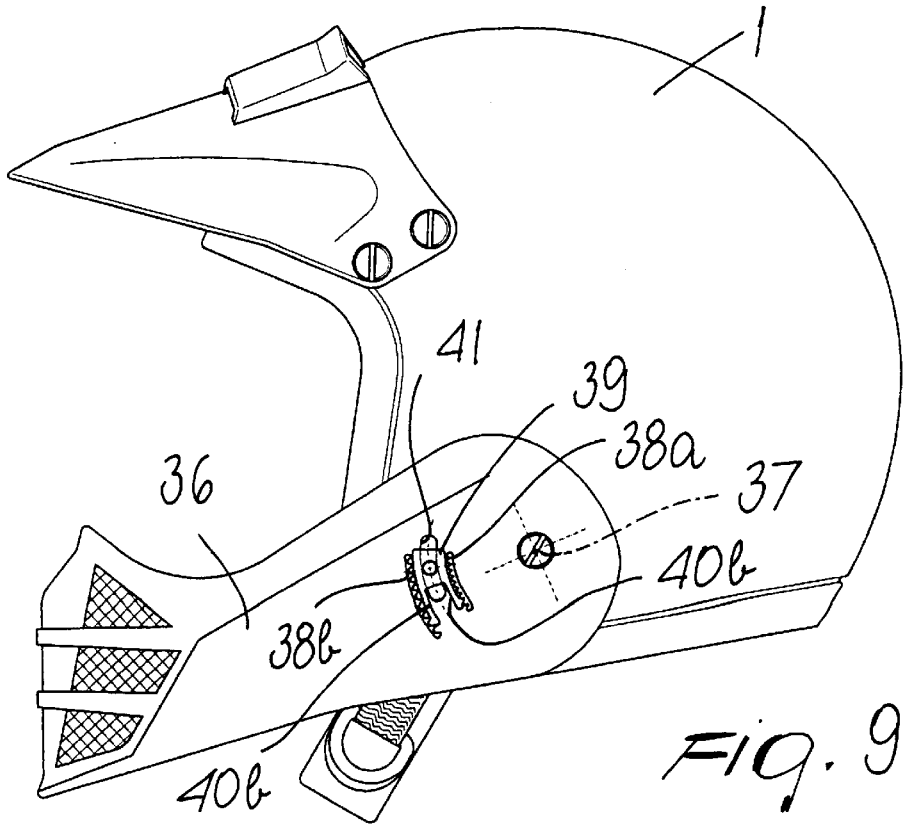
FIG. 9 is a schematic view of a helmet according to the invention, with the device for locking and releasing movable parts applied to an attached chin-guard.

FIG. 9 illustrates the device according to the invention applied to an attached chin-guard 36 which is hinged, at its lateral ends, to two lateral-lower regions of the helmet body 1 about a hinge axis 37 which is parallel to the front of the helmet.

In this case also, the racks 38*a* and 38*b* corresponding to the racks 7*a* and 7*b* have an arc-like shape which is centered on the hinge axis 37. The block 39, which corresponds to the block 8, is provided with arc-like wings 40*a* and 40*b*, as already described with reference to the locking of the visor 30 shown in FIG. 8. The slot 41, which corresponds to the slot 17, also has an arc-like shape centered on the hinge axis 37 and the slider 11, not shown for the sake of simplicity, is movable from the locking position to the release position along a curved path which is centered on the hinge axis 37, in a manner which is similar to what has been described with reference to FIG. 8.

The device according to the invention can also be used to lock or release other movable parts, such as for example panels or sliders for opening-closing air intakes provided in the helmet.

In practice it has been observed that the helmet with the device for locking and releasing movable parts according to the invention fully achieves the intended aim, since it is extremely easy to use and offers adequate assurances of safety in the locking of the movable parts.

The helmet with the device for locking and releasing movable parts thus conceived is susceptible of numerous modifications and variations, all of which are within the scope of the inventive concept; all the details may also be replaced with other technically equivalent elements.

In practice, the materials employed, as well as the dimensions, may be any according to requirements and to the state of the art.

The disclosures in Italian Patent Application No. M198A001458 from which this application claims priority are incorporated herein by reference.

What is claimed is:

1. A crash-helmet with a device for locking and releasing movable parts, comprising a helmet body and a part which is associated with said helmet body and is movable with respect to said helmet body along a movement path, a device being provided for locking and releasing said movable part, wherein said device comprises a first member, which is associated with said movable part and is provided with engagement regions which are mutually spaced along said movement path, and a second member, which is associated with the helmet body and is provided with at least one retention element engaging at least one of said engagement regions, said retention element being flexible in order to allow the movement of said movable part with respect to the helmet body and sequentially engaging said engagement regions when said movable part moves with respect to the helmet body, a locking member being provided which can engage said retention element in order to prevent its elastic yielding, locking the movement of said movable part with respect to the helmet body, or can be disengaged from said retention element to allow its elastic yielding.

2. The helmet according to claim 1, wherein said first member comprises at least one rack which is rigidly coupled to said movable part.

3. The helmet according to claim 2, wherein said second member comprises a block which is associated with the helmet body, said retention element comprising at least one elastically flexible wing of said block which is provided with a lug which can engage or disengage, by means of its elastic flexibility, grooves of a set of teeth of said rack.

4. The helmet according to claim 3, wherein said locking member comprises a slider which is associated with the helmet body and is provided with a locking tooth, said slider being movable on command from a locking position, in which it engages, by means of its locking tooth, said at least one elastically flexible wing in order to prevent its elastic flexing, to a release position, in which it is disengaged from said wing and viceversa.

5. The helmet according to claim 1, wherein said first member comprises two racks with mutually facing sets of teeth lying parallel to said movement path, said second member comprising a block which is provided with a pair of wings arranged between said two racks, each having a lug which engages one of said racks, said wings being elastically flexible towards each other to sequentially engage and disengage their lugs with grooves of said racks; said locking member comprising a slider which is provided with a locking tooth and is movable from a locking position, in which it engages, by means of said locking tooth, between said two wings in order to prevent their flexing towards each other, to a release position, in which said locking tooth is disengaged from said wings to allow their flexing towards each other and viceversa.

6. The helmet according to claim 5, wherein said slider is associated with the helmet body so that it is slideable in a sliding direction which is substantially parallel to said movement path and is movable in said sliding direction from said locking position to said release position and vice versa.

7. The helmet according to claim 1, wherein said movable part is constituted by a sunshade which is hinged to two upper-lateral regions of the helmet body about a hinge axis which is substantially parallel to the front of the helmet, said device being mounted at the top of the helmet body on a portion of said sunshade lying above the helmet body.

8. The helmet according to claim 5, wherein said movable part is constituted by an attached chin-guard which is hinged to two lateral lower regions of the helmet body, about a hinge axis which is substantially parallel to the front of the helmet, said two racks being arranged along circular arcs which are centered on said hinge axis and said slider being movable along a curved path which is centered on said hinge axis in order to pass from said locking position to said release position and viceversa.

9. The helmet according to claim 5, wherein said movable part is constituted by a visor which is hinged to two lateral regions of the helmet body about a hinge axis which is substantially parallel to the front of the helmet, said two racks being arranged along circular arcs which are centered on said hinge axis and said slider being movable along a curved path which is centered on said hinge axis in order to pass from said locking position to said release position and viceversa.

* * * * *